United States Patent [19]

Lasier et al.

[11] Patent Number: 4,835,905

[45] Date of Patent: Jun. 6, 1989

[54] DOOR POSITION INDICATOR FOR A DOOR CLOSER

[75] Inventors: Thomas R. Lasier, Princeton; William L. Downey, Peru, both of Ill.

[73] Assignee: Schlage Lock Company, San Francisco, Calif.

[21] Appl. No.: 162,188

[22] Filed: Feb. 29, 1988

[51] Int. Cl.[4] ..... G08B 13/08

[52] U.S. Cl. ..... 49/14; 49/336; 16/52; 16/58

[58] Field of Search ..... 49/13, 14, 334, 15, 49/336, 335, 404; 16/52 X, 58 X, DIG. 9, DIG. 10

[56] References Cited

U.S. PATENT DOCUMENTS

| | | | |
|---|---|---|---|
| 3,973,357 | 8/1976 | Kluempers | 49/13 |
| 4,208,755 | 6/1980 | Shepherd | 49/404 |
| 4,222,147 | 9/1980 | Burnett, Jr. | 49/13 X |
| 4,285,094 | 8/1981 | Levings, Jr. | 16/52 |
| 4,334,388 | 6/1982 | Kambic | 49/13 X |
| 4,721,946 | 1/1988 | Zunkel | 49/13 X |

*Primary Examiner*—Philip C. Kannan
*Attorney, Agent, or Firm*—Walter C. Vliet

[57] ABSTRACT

A door position indicator for a door closer which senses the position of a door closer piston as a means of sensing door position. The door closer and hence the door position indicator may be recessed in the door jamb over the top edge of the door thereby providing additional security to the door position sensing device.

11 Claims, 1 Drawing Sheet

DOOR POSITION INDICATOR FOR A DOOR CLOSER

BACKGROUND OF THE INVENTION

The present invention relates to an on-board door position indicator that is part of a package including a modified door closer. It is intended to be used in high security locations, such as jails, where it will control the ceiling and/or corridor or other security doors and send a signal to a security office or monitor as to the closed or open condition of the door. The unit is concealed in the head frame or possibly, alternatively, the door still of the doorway with the door track concealed in the top or bottom of the door as the case may be. Since the entire unit is concealed within the door frame, or door itself, the device is vandalproof when the door is closed. The object of the invention, therefore, is to provide a simple, safe and reliable means of both closing a security door and advising as to its open or closed condition in a reliable vandalproof manner. These and other objects are obtained in a door control and position sensing device comprising:

A door closer housing having a piston disposed within said housing for movement proportionately associated with a door; means for sensing the position of the piston at at least one point in its travel as a means of determining the position of the piston and thereby the associated door position.

DETAILED DESCRIPTION OF THE PREFERRED EMBODIMENT

Figure 1:
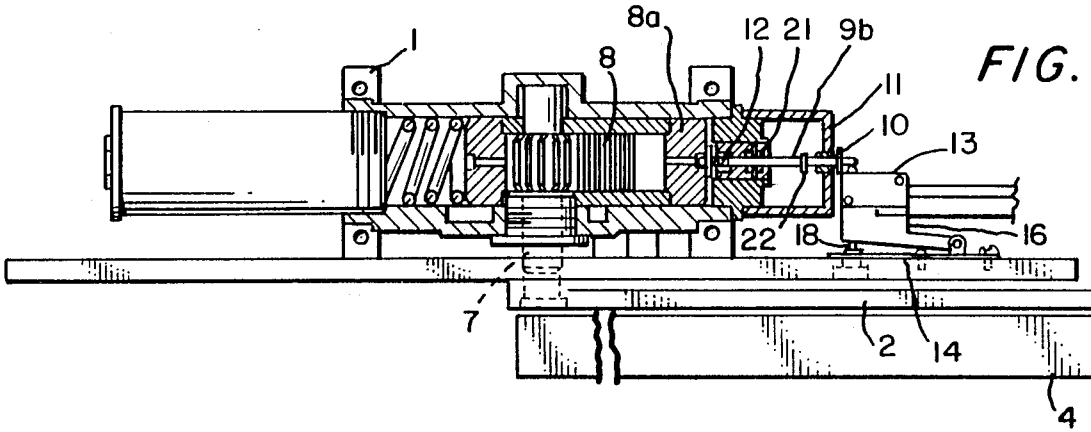
FIG. 1 shows a partially sectioned side elevation of a door closer and position sensing device according to the present invention.

Referring to FIG. 1, a modified conventional door closer is shown, such as manufactured by LCN Closers, a division of Schlage Lock Company. The particular door closer shown in FIG. 1 has two independent adjustable closing speed zones, an adjustable backcheck zone and adjustable spring power to control the door in the opening and closing swings.

An on-board door position indicator switch relays a signal to a remote control station indicating whether the door is open or closed, and also can be connected to the circuit which controls and reports the status of the door lock and bolt condition.

Figure 4:
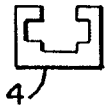
FIG. 4 is an end view of the closer track as viewed from FIG. 1.

The door closer body 1, is connected to the door with a tamper resistant arm 2, and roller 3, that traverses a track 4, concealed in the top of the door. A wiper 5, at the arm/roller connection clears foreign objects in the path of the roller 3, by expelling debris from either open end of the track (best seen in FIG. 4); or by raising the debris out of the track along sloped ramp 6 at the end(s) of track 4.

Figure 3:
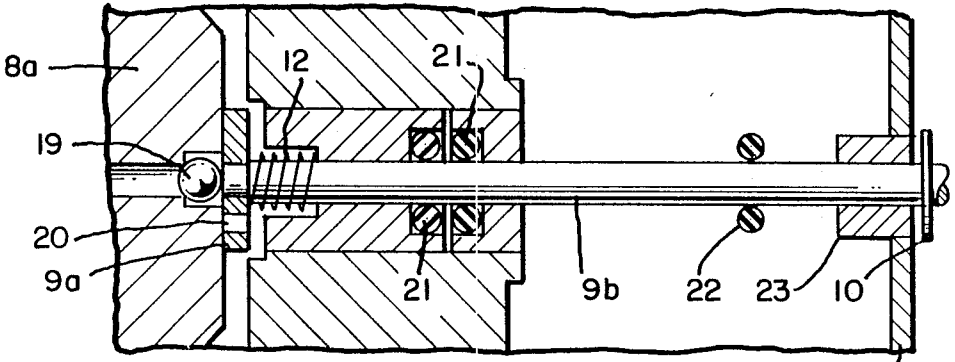
FIG. 3 is a cross section detail of the trip rod according to the present invention.

The closer end of arm 2, is attached to the closer pinion shaft 7. Rotation of pinion 7, moves piston 8, laterally in the closer cylinder body as the door opens and closes. When piston 8, moves to the left during the door opening swing, flange end 9*a*, of trip rod 9*b*, follows piston 8, until stop ring 10 abuts reservoir case 11, or spring 12 relaxes ending the lateral movement of the trip rod assembly 9. This translation of trip rod 9*b*, supported by bushing 23, away from switch 13, reverses the contacts in the switch sending a signal through the normally closed/normally open circuit that the door has been moved from the closed position. conversely, as the door closes, the track 4, roller 3, arm 2, and pinion 7, combination moves the piston 8 to the right. As the door nears the closed position, piston head 8*a*, abuts flange 9*a*, of trip rod assembly 9, depressing return spring 12 (see detail in FIG. 3), while urging trip rod 9*b*, against switch 13, switching the circuit to send a signal that the door is closed.

An overtravel feature beyond the trip point of switch 13, allows additional movement of trip rod 9*b*, without changing the status of the signal circuit. This advantageous feature permits the door to be moved in and out within the confines of the door locking bolt (door rattle) in the lock strike without sending a door open signal.

Figure 2:
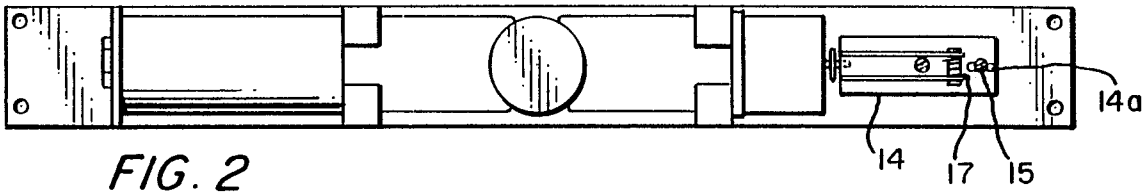
FIG. 2 shows a stop or plan view of the closer portion and its associated position sensing switch.

Switch mounting base 14 (best seen in FIGS. 1 and 2) can be moved laterally along slotted holes 14*a*, to adjust the location of switch 13, with respect to trip rod 9*b*, and is secured with screws 15. Switch 13 is supported by switch channel 16 which is pivotally hinged at its right end to switch mounting base 14. Torsion spring 17, mounted at the pivot point, exerts sufficient pressure to hold switch channel 16, against adjusting screw 18. Adjusting screw 18, locates switch 13, vertically with reference to trip rod 9*b*, to provide a fine tuning adjustment for the installer that permits him to selectively choose the point during the closing of the door where a signal will be given that the door is at a predetermined distance from the door stop (closed position).

It is important that during the door opening cycle the hydraulic fluid within the closer cylinder be permitted to flow freely through ball check valve 19, to the low pressure side of piston head 8*a*. A hole 20, has been provided in trip rod flange 9*a*, to assure this free flow even when flange 9*a*, abuts piston head 8*a*.

Seals 21, typically shown as, but not restricted to O-rings, are used to confine the hydraulic fluid within the door closer cylinder. It is recognized that eventually all seals may seep fluid and therefor reservoir case 11, has been provided to receive any fluid that may seep along trip rod 9*a*.

An additional seal 22, shown as an O-ring, is mounted on trip rod 9*b*, to serve as a barrier to capillary action of fluid along the trip rod. If any fluid seep creeps along trip rod 9*b*, it will be stopped at barrier seal 22, and drip into reservoir case 11.

Having described my invention in terms of a preferred embodiment we do not wish to be limited in the scope of our invention except as claimed.

I claim:

1. A closure control and position sensing device comprising: a closure means closer device having a housing adapted for concealment in a closure frame; a force producing means within said closer device for delivering a closing force to said closure means; said force producing means moving in known relationship to said closure means; means in contact with said force producing means for sensing the poistion of said force producing means as a means for sensing the position of said closure means.

2. A closure control and positioning sensing device according to claim 1 wherein: said closer device comprises a hydraulic door closer; said force producing means comprises a spring loaded hydraulic piston means for closing said closure in a controlled fashion; and said means for sensing position of said piston comprises a sealed plunger means coacting with said force producing means and with a position sensing switch.

3. A closure control and position sensing device according to claim 2 wherein: said switch means is adjustable to accommodate the location of closure means position within an acceptable tolerance range.

4. A door control and position sensing device comprising: a door closer having a housing; a piston disposed in a bore within said housing; said piton moving in said bore in known relation to movement of said door; and means for sensing the position of said piston in at least one position in the travel of said piston as a means of detecting the door position; a pivot arm means for transmitting movement of said piston to movement of said door; and track means concealed in said door edge for coacting with said pivot arm means to effect door opening and closing; said track means, said door closer, and said pivot arm means all on closure form a parallel aligned substantially concealed security device.

5. A door closure and control device in combination with a door comprising: a door closer having force producing means to close a door mounted in a door frame in a position concealed by said door in its closed position; a pivot arm connecting said door closer and said door; track means concealed in said door for coacting with said pivot arm connection to effect door closure; said track means, said pivot arm and the longitudianl axis of said door closer arranged in parallel arrangement of closure to form a self protected and substantially concealed door closure device; and position sensing means for sensing a position of an operative element of said force producing means of said door closer which is concealed on closing and moves in relation to the position of said door as a means of security for said position sensing means and for determining the position of said door.

6. A door closer and control device according to claim 5 wherein: said pivot arm connection to said track means comprises a roller device; said roller device further comprising means for clearing said track means of debris which might otherwise effect operation.

7. A door closer and control device according to claim 6 wherein: said means for clearing said track consists of a wiper on said roller device and a sloped ramp in said track.

8. A door closure device according to claim 5 wherein: said operative element of said door closer comprises: a hydraulic piston within said door closer; and said position sensing means further comprises a trip rod which contacts said piston means at the end of its travel associated with a door closed position.

9. A door closure and control device according to claim 8 wherein: said trip rod further comprises a seal member which transmits movement of said piston to a switch means as a means of signalling position of said piston and hence position of said door.

10. A door closure and control device according to claim 9 wherein: said switch means is adjustable to accommodate door position variations.

11. A door closure and control device according to claim 10 wherein: said trip rod further is encased in a reservoir means as a means of minimizing hydraulic fluid leakage and said piston means and said trip rod are further providing with a means of expelling hydraulic fluid from a ball check valve in said piston head; and said means for expelling fluid comprises a hole in the trip rod at a flange face which cooperates with said piston.

* * * * *